United States Patent [19]

Richards

[11] 4,101,016

[45] Jul. 18, 1978

[54] COIN TESTING APPARATUS

[75] Inventor: Basil James Richards, Vaucluse, Australia

[73] Assignee: New Century Novelty Company Pty. Limited, Mascot, Australia

[21] Appl. No.: 788,563

[22] Filed: Apr. 18, 1977

[30] Foreign Application Priority Data

Apr. 27, 1976 [AU] Australia ..... 5718/76

[51] Int. Cl.[2] ..... G07F 3/02

[52] U.S. Cl. ..... 194/97 A

[58] Field of Search ..... 194/97 A, 103

[56] References Cited

U.S. PATENT DOCUMENTS

| | | | |
|---|---|---|---|
| 2,256,486 | 9/1941 | Lindberg | 194/103 |
| 2,565,177 | 8/1951 | Hokanson | 194/103 X |

*Primary Examiner*—Allen N. Knowles

*Attorney, Agent, or Firm*—Ladas, Parry, Von Gehr, Goldsmith & Deschamps

[57] ABSTRACT

In coin selection apparatus a device for performing a rim check on coins and comprising a swinging cradle provided with a pair of jaws having confronting points to grip a coin and a pivoted carriage to support the weight of the coin and to close the jaws upon the coin, bias means for restoring the cradle to rest with such a force as to be overcome by the weight of a coin held within the jaws so that the cradle carrying said coin swings from above a coin reject chute to above a coin pass chute, said coin being retained temporarily between the points of the jaws of the cradle if the coin includes a protruding rim and thus being carried for depositing within the coin pass chute.

9 Claims, 2 Drawing Figures

COIN TESTING APPARATUS

This invention relates to coin selection apparatus of the kind which performs numerous tests upon an inserted coin in order to establish its authenticity and discharges rejected coins through a separate chute from other coins.

Higher denomination coins usually have a silver content and are minted with a protruding rim. Coin selection apparatus, therefore, when designed to test these coins should include means for checking both the coin's weight and the existence of a rim. These functions are conventionally performed by independent devices within the testing apparatus. For rim checking of coins opposed, spring-loaded, coacting conical points are provided to grip the coin momentarily behind its rim thereby to deflect it from a path into a reject chute. It has been found that the adjustment of such conical points is critical and through the ingress of dirt, and for other reasons, require regular maintenance.

It is the main object of this invention to provide means for performing a rim check on coins in coin selection apparatus which functions efficiently while requiring relatively little maintenance.

According to the invention in one general form there is provided a device for providing a rim check of coins in coin selection apparatus which has discrete chutes within its body provided, respectively, for authentic and reject coins, said chutes having juxtaposed entrances, said device comprising a cradle pivoted to the body at a position above and adjacent to said entrances, and means for biasing said cradle to a rest position, said cradle including a frame, tongs having coin-gripping jaws at one end and pivoted with respect to the frame, and a carriage pivoted with respect to the frame and responding to the weight of a coin to impose a closing force on said jaws of the tongs to clamp them upon said coin and to cause the cradle to pivot to a coin discharge position while said jaws continue to grip said coin.

Figure 1:
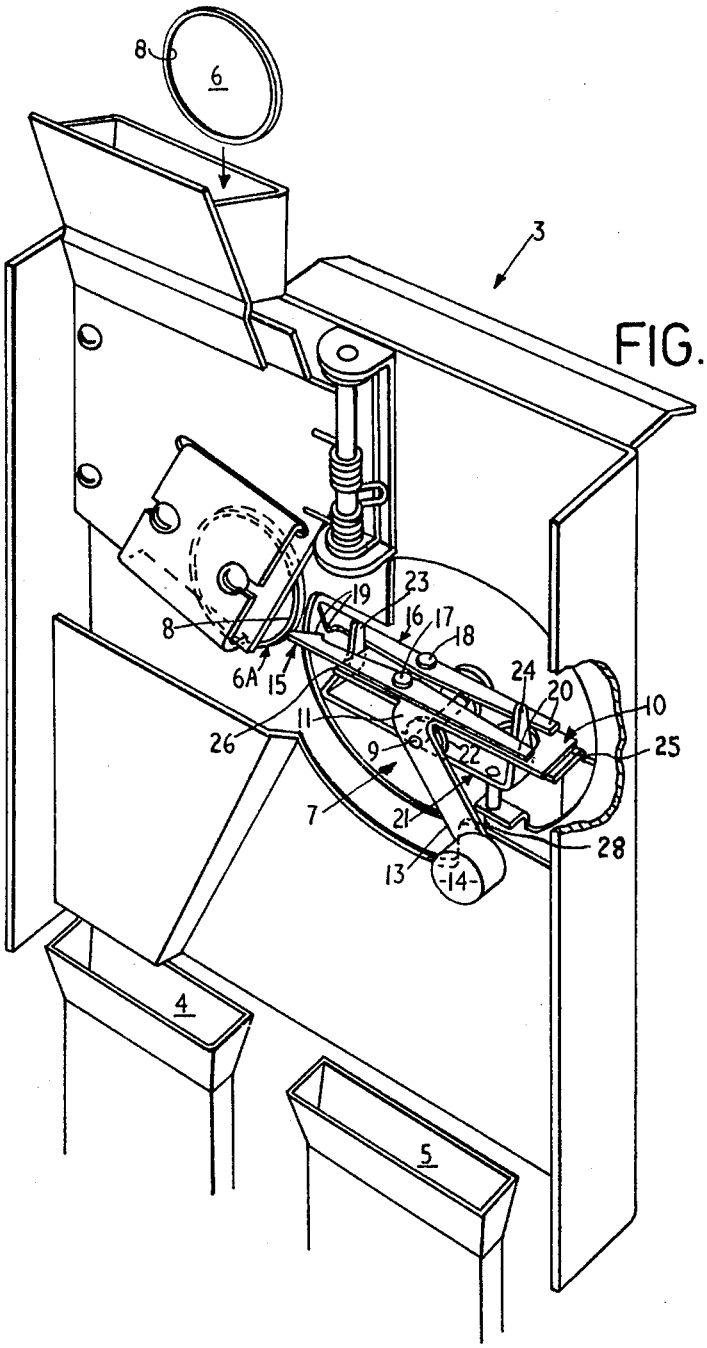
Figure 2:
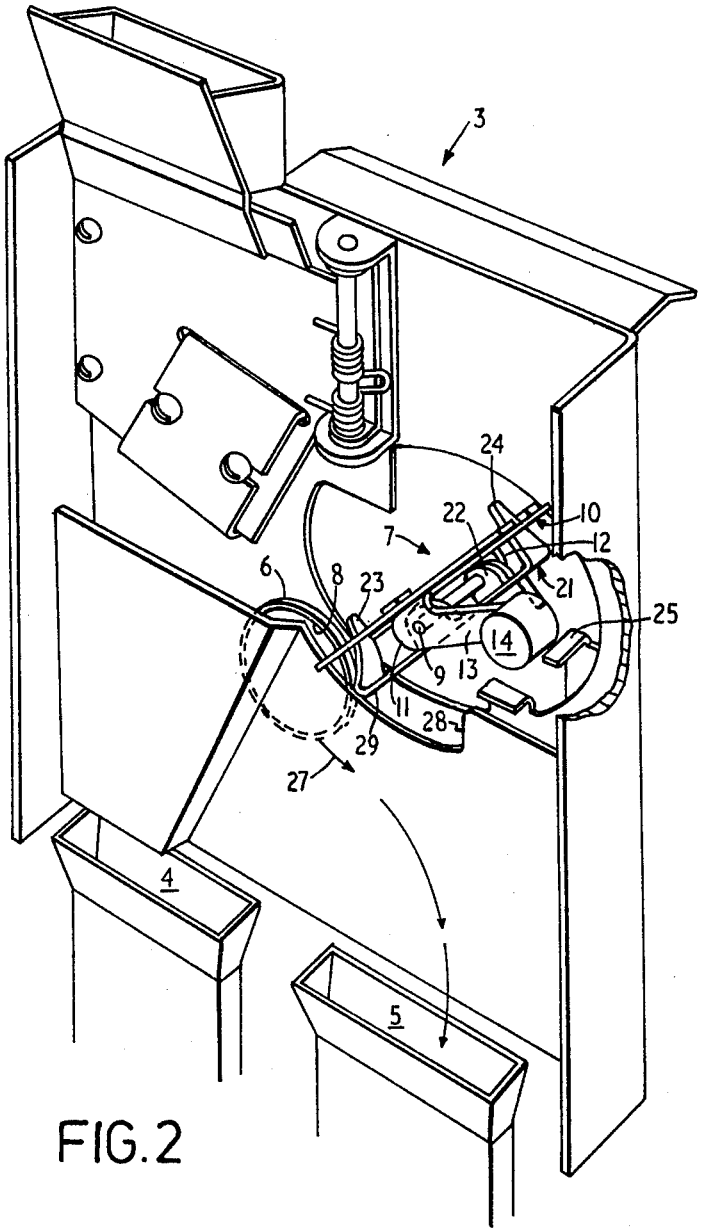

A preferred embodiment of the invention is illustrated in the accompanying drawings, in which:

FIG. 1 is a perspective view of the device showing a genuine coin being offered up to said device; and FIG. 2 is a similar perspective view showing the genuine coin being swung over in the pivoting cradle to the appropriate chute.

The preferred embodiment illustrated in the drawings will now be described wherein the coin rim-check device is incorporated in coin selecting apparatus 3, and is preferably the final check made of coins offered thereto. From the rim-check device juxtaposed entrances to two coin chutes 4 and 5 permit discharge of coins 6 from the apparatus at two locations depending upon whether the coin 6 is authentic or has been rejected by the apparatus. The device consists of a cradle 7 pivoted to the body of the coin selection apparatus 3 and accepts coins 6 offered to it and carries them arcuately for a distance depending upon whether or not they are provided with a prescribed rim 8. If a coin 6 is so provided it is held in the cradle 7 and carried a greater distance to be discharged into the entrance of the chute 5 appropriate to authentic coins.

The cradle 7 of the device is pivoted at 9 to the body of the apparatus above and adjacent the two entrances to the chutes 4 and 5, and consists of a flat baseplate 10 with opposite laterally depending legs 11 and 12 bored to accept a pivot pin 9 carried on the apparatus body.

One leg 11 is extended to provide an integral inclined arm 13 carrying at its end a counterweight 14 for returning the cradle 7 to a rest condition. A pair of coacting tong-like arms 15 and 16 are pivoted at 17 and 18, respectively, between their ends upon the baseplate 10 and are provided at one end with confronting coin-gripping jaws 19 and at the other with operating arms 20.

The cradle also comprises a lower carriage 21 formed as an elongated platform having opposite upwardly directed lateral arms 22 bored to pivot upon the said pivot pin 9, and at opposite ends carrying tapered, upwardly directed, projections 23 and 24. These projections 23 and 24 are so located that if the carriage 21 is rotated or rocked with respect to the cradle baseplate 10 its projections 23 and 24 will, in one direction separate the operating arms 20 of the tongs 15 and 16 to close their jaws 19, and in the other direction separate said jaws 19. The projections 23 and 24 may be of similar kind and may be composed of a triangular, or pointed post. The underside of the platform of the carriage 21 may engage an abutment 25 on the apparatus body for arresting the cradle 7 at the rest position against the action of the counterweight 14 as shown in FIG. 1.

The passage of coins 6 through the coin selection apparatus, and the positioning and arrangement of the cradle 7, is such that upon insertion of a coin 6 it passes tangentially as at 6A (FIG. 1) into the gripping jaws 19 of the tongs 15 and 16 while simultaneously being seated at a lower part of its circumference on an end of the platform 26 of the carriage 21. The weight of the coin 6 will cause rotation of the carriage 21 so as to close the jaws 19 of the tongs 15 and 16 so that the coin 6 is gripped behind its rim 8 by the jaws 19 as shown in FIG. 2 with a force depending upon the coin's weight. The weight of the coin 6 will additionally rotate the cradle 7 from an approximately horizontal position, at rest as in FIG. 1, to carry the coin through a downward arc 27 (see FIG. 2). This produces, due to the outward displacement of the coin's centre of gravity, a reducing closing force, during swinging, on the jaws 19 of the tongs 15 and 16. The device is thus capable of adjustment to provide adequate checking both of the weight of the coin 6 and the presence of a rim 8 thereon. If the correct conditions are met the coin 6 will be carried through a greater arc 27 and discharged into the chute 5 spaced beyond the reject chute 4. If desired, a stop 28 may be provided on the body of the apparatus to arrest the rotation of the cradle 7 by abutting the underside 29 of the carriage 21 adjacent the coin 6. This will cause the respective projection 23 on the carriage 21 to be introduced between the tongs 15 and 16 to separate its jaws 19 and release the coin 6.

A preferred embodiment has been described in the foregoing passages but it should be understood that other forms, and embodiments are possible within the scope of this invention.

What I claim is:

1. A device for providing a rim check of coins in coin selection apparatus which has discrete chutes within its body provided for the passage, respectively, of authentic and reject coins, said chutes having juxtaposed entrances, said device comprising a cradle pivoted with respect to the body at a position above and adjacent to said entrances, and means for biasing said cradle to a rest position, said cradle including a frame, tongs having coin-gripping jaws at one end and being pivoted with respect to the frame, and a carriage displaceably mounted on the frame and responding to the weight of a coin to impose a closing force on said jaws of the tongs to clamp them upon said coin and to cause the cradle to pivot to a coin discharge position while said jaws continue to grip said coin.

2. A device according to claim 1, wherein the carriage is pivoted on the frame and includes means for closing the jaws of the tongs when in a first one of said positions and means for opening the jaws of the tongs when in a second one of said positions.

3. A device according to claim 2, including means for guiding a coin for checking to the cradle in its rest position at a location where the coin protrudes between said jaws to engage said carriage so as to pivot it to said first position, whereby said coin becomes clamped between said jaws.

4. A device according to claim 3, wherein said carriage is a platform beneath the frame and the tongs are mounted on the top of the frame, said platform having a forward end and a rear end with its forward end adjacent the jaws of the tongs and having an abutment for engaging a coin, and the means for closing said jaws is located near said rear end and the means for opening said jaws is located near said forward end.

5. A device according to claim 4, wherein the pivot for said tongs is intermediate the ends thereof with said jaws at a forward end and operating arms therefor at the rear end, and wherein said means for closing said jaws and said means for opening said jaws are upward projections on said platform which engage respective ends of said tongs.

6. A device according to claim 5, wherein the force from said biasing means for said cradle is such as to be overbalanced by the weight of a coin grasped by the jaws of said tongs, whereby said cradle pivots away from its rest position to a coin discharge position whereat said coin drops from said jaws into said authentic coin chute.

7. A device according to claim 1, wherein said biasing means for the cradle is a counterweight, and said carriage is pivoted so as to rock between two positions and is urged to a first one of said positions by said counterweight and to a second one of said positions by the weight of a coin being checked.

8. A device according to claim 7, wherein limit stops are provided on said body to engage said cradle at said two positions thereof.

9. Coin selection apparatus comprising an entry slot for coins, a passage from said slot to guide a falling coin to the entry position of a checking location, a first chute for coins rejected by said apparatus beneath said entry position, a second chute for coins passed by said apparatus to one side of said first chute, and a pivoted cradle having a forward end swinging from said entry position to a deflected position above said second chute when engaged by a coin, said cradle having a frame mounting tong-like coin-gripping means including a pair of jaws at its forward end with confronting points and a pivoted carriage beneath said coin-gripping means including means for closing said jaws in response to the weight of a coin, said cradle also including means for biasing it towards a rest position where a coin arriving at said entry position protrudes between said jaws to engage said carriage and thereby close said jaws, and said biasing means exerting such a force as to be overbalanced by the weight of said coin to cause said forward end of the cradle to swing from said rest position to said deflected position.

* * * * *